US006360558B1

(12) United States Patent
Woog

(10) Patent No.: US 6,360,558 B1
(45) Date of Patent: Mar. 26, 2002

(54) COMBINATION CARRIER AND COOLER FOR BEVERAGE CONTAINERS

(76) Inventor: Gunter Woog, 5435 Bauers Dr., West Bend, WI (US) 53095

( * ) Notice: Subject to any disclaimer, the term of this patent is extended or adjusted under 35 U.S.C. 154(b) by 0 days.

(21) Appl. No.: 09/782,113

(22) Filed: Feb. 13, 2001

(51) Int. Cl.[7] ..... F25D 3/08
(52) U.S. Cl. ..... 62/457.5; 206/141; 206/427
(58) Field of Search ..... 62/457.5, 457.4; 206/427, 141, 162; 220/501, 592.17

(56) References Cited

U.S. PATENT DOCUMENTS

| | | | | | |
|---|---|---|---|---|---|
| 2,860,816 | A | | 11/1958 | Fielding | 220/113 |
| 3,605,435 | A | * | 9/1971 | Taylor | 206/427 |
| 4,238,069 | A | | 12/1980 | Morris, Jr. | 229/52 B |
| 4,531,381 | A | * | 7/1985 | Toro et al. | 62/457.4 |
| 4,858,444 | A | * | 8/1989 | Scott | 62/457.5 |
| 4,899,553 | A | * | 2/1990 | Drummond, III | 62/457.5 |
| 5,040,672 | A | | 8/1991 | DeMaio et al. | 206/162 |
| 5,423,478 | A | | 6/1995 | Roosa | 229/117.5 |
| 5,558,224 | A | * | 9/1996 | Fogle | 206/427 |
| 6,058,733 | A | * | 5/2000 | Morgan | 62/457.5 |
| 6,065,303 | A | * | 5/2000 | Harris | 62/457.5 |
| 6,164,526 | A | * | 12/2000 | Dalvey | 62/457.5 |

* cited by examiner

*Primary Examiner*—William E. Tapolcai
(74) *Attorney, Agent, or Firm*—Ryan Kromholz & Manion, S.C.

(57) ABSTRACT

A carrier for beverage containers formed of a sheet material such as paperboard includes a bottom panel attached on opposite lateral sides to outwardly sloping lower side panels, a pair of opposed end panels connected at their lower peripheries to the bottom and side panels, a pair of upper side panels each integrally connected to the upper periphery of one of said lower side panels. The upper side panels are provided with a plurality of openings, for example, six, each of which is adapted to receive a beverage container. The upper side panels are also integrally connected at their ends to the end panels and to a top panel which is integrally connected on its sides to the upper edges of the upper side panels and to the end panels. The top panel is provided with openings for access to the central interior of the carrier which allows for filling the carrier interior with ice. The top panel is preferably provided with a raised central portion which serves as a carrying handle for the carrier. A top closure panel is provided which is adapted to close the access openings. The interior of said carrier may be provided with waterproof protective inner lining, which may be a flexible plastic sheet material such as polyethylene or polypropylene.

7 Claims, 2 Drawing Sheets

COMBINATION CARRIER AND COOLER FOR BEVERAGE CONTAINERS

BACKGROUND OF THE INVENTION

The present invention relates to a beverage container carrier suitable for sale and transportation of beverages in containers such as cans or bottles, and which also serves as a disposable cooler for the containers.

Collapsible paperboard carriers for beverages contained in cans or bottles are commonplace in the industry. Examples of various such carriers are shown in U.S. Pat. No. 2,860,816 issued Nov. 18, 1958 and U.S. Pat. No. 5,040,672 issued Aug. 20, 1991. Such carriers are examples of one of the many types of commercially used packaging used in the transportation and sale of canned and bottled beverages such as soda, beer, wine coolers, etc.

SUMMARY OF THE INVENTION

The present invention relates to the novel adaptation of a common beverage six-pack which enables the same to perform a dual function wherein it also serves as an ice-containing cooler for the beverage containers. The cooler may be either disposable either after a single use or optionally after multiple uses.

Briefly summarized, the invention provides a carrier for beverage containers formed of a sheet material such as paperboard which includes a bottom panel attached on opposite lateral sides to outwardly sloping lower side panels, a pair of opposed end panels connected at their lower peripheries to the bottom and side panels, and a pair of upper side panels each integrally connected to the upper periphery of one of said lower side panels. The upper side panels are provided with a plurality of openings, for example, six, each of which is adapted to receive a beverage container. While 6 openings are used in the preferred embodiment, it will be understood that other configurations having 4, 8 or even 12 openings can be used. The upper side panels are also integrally connected at their ends to the end panels and to a top panel which is integrally connected on its sides to the upper edges of the upper side panels and to the end panels. The top panel is provided with openings for access to the central interior of the carrier which allows for filling the carrier interior with ice. The top panel is preferably provided with a raised central portion which serves as a carrying handle for the carrier. A top closure panel is provided which is adapted to close the access openings. The interior of said carrier may be provided with waterproof protective inner lining, which may be a flexible plastic sheet material such as polyethylene or polypropylene.

The invention will be further set forth in the detailed description, accompanying claims and in the drawings.

DETAILED DESCRIPTION OF THE INVENTION

Figure 1:
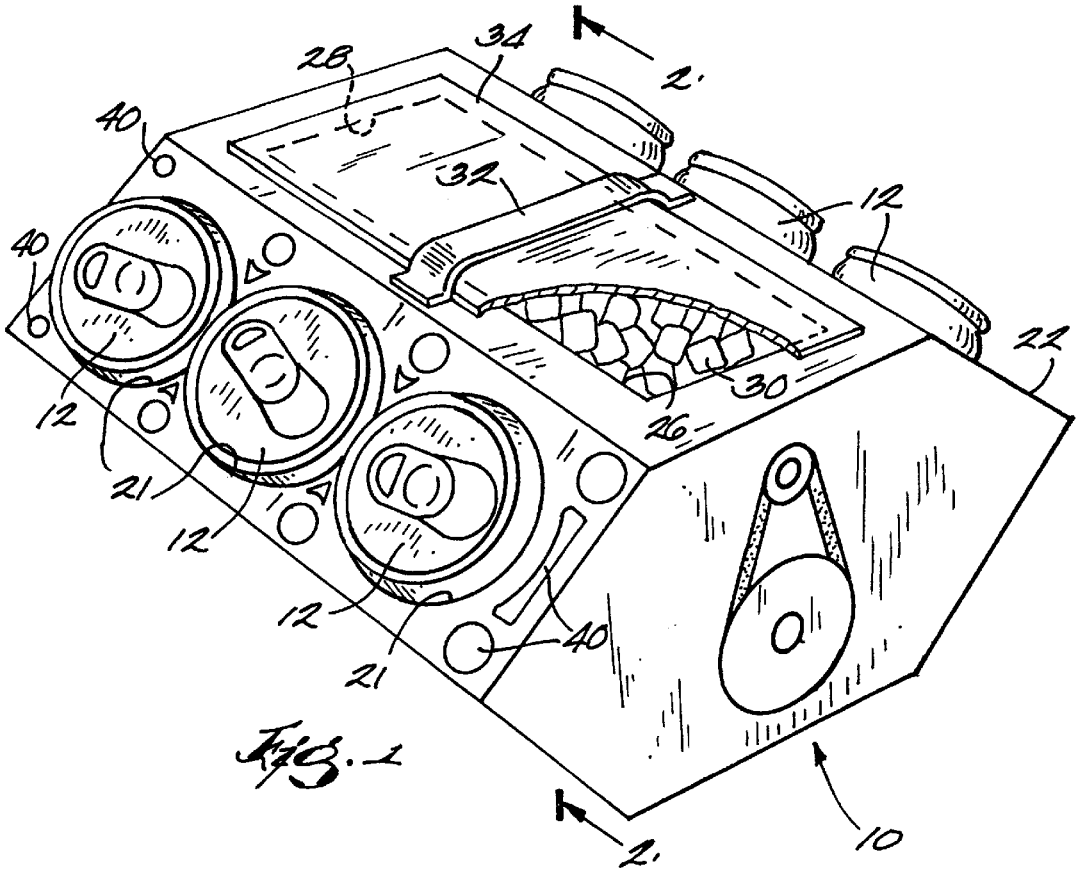
FIG. 1 is a perspective view illustrating a carrier/cooler of the present invention in conjunction with canned beverages and showing the same partially filled with ice and with the cover partially broken away.
Figure 2:
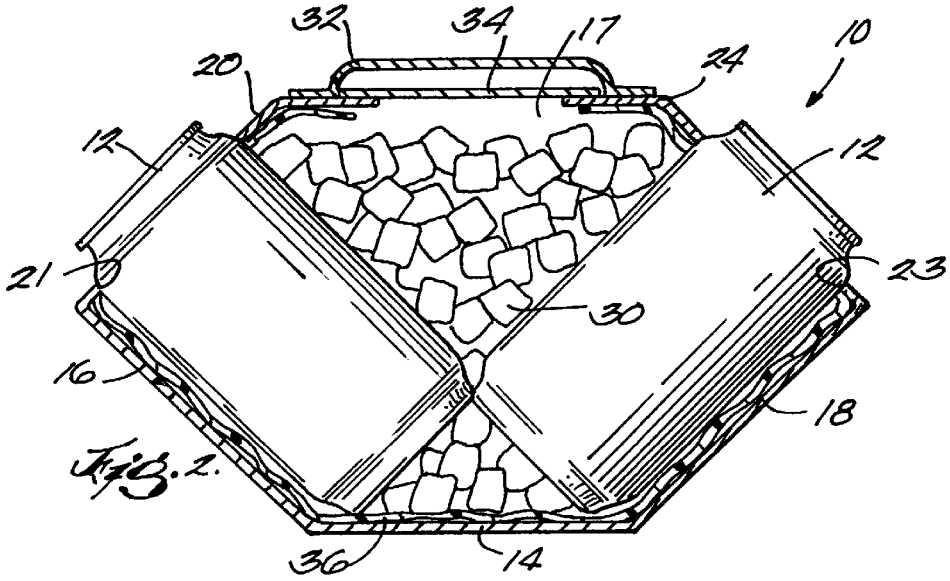
FIG. 2 is a sectional view taken along line 2—2 of FIG. 1 but also showing a cover in place.

Referring more particularly to the drawings there is seen in FIGS. 1 and 2 a carrier device 10 of this invention. In the illustrated embodiment carrier 10 is designed to contain six containers, which in the illustrated embodiment are conventional beverage cans 12.

Carrier 10 is formed from a sheet material such as paperboard or, alternatively, of a plastic material. Carrier 10 is defined by a bottom panel 14 to which are attached on each lateral side sloping lower side panels 16 and 18 which are also connected to opposed end panels 15 and 17. The upper peripheries of the lower side panels 16 and 18 are integrally connected to upper side panels 20 and 22, respectively. Openings 21 and 23 are provided in the upper side panels 20 and 22, respectively for access to and display of the containers 12. The upper side panels 20 and 22 are also integrally formed at their ends to end panels 15 and 17. The upper edges of upper side panels 20 and 22 as well as the end panels 15 and 17 are all integrally connected to a top panel 24.

Top panel 24 is provided with enlarged openings 26 and 28 which permit access to the interior of the container carrier 10. This access enables filling of the interior of the carrier with ice cubes 30, as desired. Top panel 24 is also provided with a slightly raised central portion 32 which serves as a carrying handle for the beverage container carrier 10. As seen in FIG. 2 the raised nature of the handle 32 enables placement thereunder of a slidable top closure panel 34, which serves to insulate the top of ice 30 by closing the openings 26 and 28.

Figure 4:
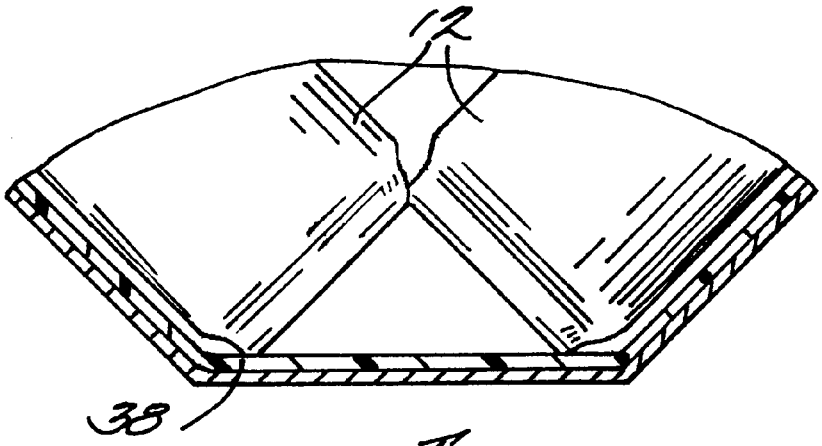

It is also desirable to provide the interior of carrier 10 with a protective inner lining 36 of a flexible plastic sheet material for example polyethylene, polypropylene, etc., particularly in cases where the body of carrier 10 is formed from paperboard which requires the benefit of a protective liner to avoid damage from the melting ice. As seen in FIG. 4 the liner may be in the form a somewhat heavier plastic tray liner 38, if desired.

It will be understood that if the sheet material from which the carrier 10 is itself formed of a plastic sheet material or molded plastic, the carrier will be provided with a longer life permitting reuse for a period of time by the consumer.

Markings 40 may be provided, if desired, to give the carrier the appearance of a mock engine block. Thus, the invention can be marketed as a novelty item to racing car enthusiasts.

Figure 3:
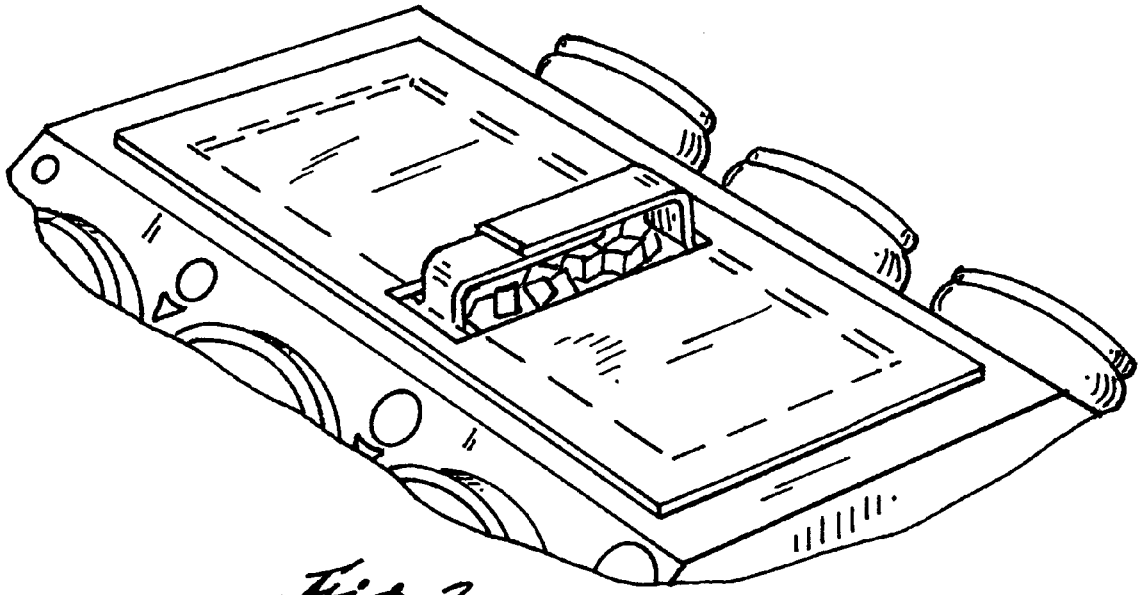
FIG. 3; is a fragmentary perspective view illustrating a further embodiment of the invention and, FIG. 4 is a fragmentary sectional view showing a somewhat modified embodiment of the invention.

The embodiment of FIG. 3 is similar to that shown in FIG. 1 with the exception that cover 40 is attached over the top of openings 26 and 28. Cover 40 is provided with an opening 46. A carrying handle, in this case may be formed of laminated tabs 42 and 44, which form a handle that extends out through the opening 46.

It will be apparent to those skilled in the art that various modifications of the foregoing illustrative embodiment are possible. Thus, the invention also encompasses any and all embodiments within the scope of the following claims.

What is claimed is:

1. A carrier for beverage containers formed of a sheet material comprising a bottom panel attached on opposite lateral sides to outwardly sloping lower side panels, a pair of opposed end panels connected at their lower peripheries to said bottom and side panels, a pair of upper side panels each integrally connected to the upper periphery of one of said lower side panels, a plurality of openings in each of said upper side panels, each of said openings being adapted to receive a beverage container, the upper side panels being integrally connected at their ends to said end panels, a top panel integrally connected on its sides to the upper edges of said upper side panels and to said end panels, the top panel being provided with openings for access to the central interior of the carrier.

2. A carrier according to claim 1 wherein said top panel is provided with a raised central portion which serves as a carrying handle for the carrier.

3. A carrier according to claim 1 wherein further comprising a top closure panel adapted to close said access openings.

4. A carrier according to claim 1 wherein the interior of said carrier is provided with waterproof protective inner lining.

5. A carrier according to claim 4 wherein said lining comprises a flexible plastic sheet material such as polyethylene or polypropylene.

6. A carrier according to claim 1 wherein said carrier is formed of paperboard.

7. A carrier according to claim 1 wherein said carrier is formed of molded plastic material.

* * * * *

UNITED STATES PATENT AND TRADEMARK OFFICE

CERTIFICATE OF CORRECTION

PATENT NO. : 6,360,558 B1
DATED : March 26, 2002
INVENTOR(S) : Woog, Gunter

It is certified that error appears in the above-identified patent and that said Letters Patent is hereby corrected as shown below:

Column 3,
Line 11, cancel the word "wherein".

Signed and Sealed this

Third Day of September, 2002

*Attest:*

*Attesting Officer*

JAMES E. ROGAN
*Director of the United States Patent and Trademark Office*